United States Patent [19]

Varga et al.

[11] Patent Number: 4,640,321

[45] Date of Patent: Feb. 3, 1987

[54] WIRE BEND MACHINE

[75] Inventors: LeRoy M. Varga, Dover; Michael F. Yermal, Wharton, both of N.J.

[73] Assignee: Rockaway Corporation, Rockaway, N.J.

[21] Appl. No.: 766,882

[22] Filed: Aug. 16, 1985

[51] Int. Cl.[4] ..... B21F 27/14

[52] U.S. Cl. ..... 140/93 C; 140/74

[58] Field of Search ..... 140/74, 93 C; 29/243.5, 29/772; 226/68, 167; 217/51

[56] References Cited

U.S. PATENT DOCUMENTS

| | | | |
|---|---|---|---|
| 1,144,750 | 6/1915 | Bluege | 140/93 C |
| 1,693,728 | 12/1928 | Rainsford | 226/167 |
| 2,091,377 | 8/1937 | Rosenmund | 140/93 C |

FOREIGN PATENT DOCUMENTS

| | | | |
|---|---|---|---|
| 1575565 | 7/1969 | France | 217/51 |

*Primary Examiner*—Lowell A. Larson

*Attorney, Agent, or Firm*—Pasquale A. Razzano

[57] ABSTRACT

In an apparatus for securing girth binding wires to the sides of an open sided flat container wherein wire manipulations are performed on a wire section secured to a container blank to bend the binding wire ends over the top edge of the sides and drive them into the container blank, first and second crossbars are provided which are respectively vertically reciprocally mounted transverse of the path of travel of the container blank. The first of the crossbars is positioned above the path of the container blank and has mounted thereon a wire manipulating device which cuts the binding wire and bends it downward as the first crossbar is lowered. The second crossbar is positioned below the path of the container blank and has a wire bending and clinching device mounted thereon such that, as the second crossbar is raised, the binding and clinching device engages the previously cut and bent wire ends and wipes them back against the bottom sides of the container blank. As the second crossbar approaches the top of its range, the wire ends are driven into the second side of the container blank.

30 Claims, 19 Drawing Figures

WIRE BEND MACHINE

BACKGROUND OF THE INVENTION

The present invention relates to an apparatus for use in manufacturing wirebound boxes, and more particularly to an apparatus for manipulating a wire secured to a wire-bound container blank to cut, bend and clinch the end of the wire into the face material of the container blank for forming a flat "plateau" crate.

Wirebound container, box, or crate blanks used to form completed wirebound containers, are customarily formed in stapling machines of the general type disclosed in U.S. Pat. No. 2,482,370 in which assembly face material or mats and reinforcing cleats are conveyed by continuously moving conveyor bands beneath stapling machine heads which drive staples astride longitudinally extending binding wires, through the face material or mats, and into the cleats to form a continuous succession of wirebound blanks each comprising several side sections foldably secured together by the binding wires. Presently, when forming box-type crates, this continuous succession of blanks is then typically fed into an RF Loop Forming machine of the type described in U.S. Pat. No. 3,970,118 wherein the binding wires are severed in the interval between adjacent blanks (the "tie wire gap") and bent to form loops whose free ends are then bent to form prongs which are driven into the face material of the mats. When the blank is folded to set up the container, the two loop fasteners at opposite ends of each of the binding wires come into position at the closing corner of the container and one of these loops, being somewhat narrower than the other, is inserted through the latter and bent down against the outer surface of the box to secure the container closed.

The RF Looping Machine, previously mentioned, has been adapted for use in the fabrication of fruit containers commonly called "flat plateau crates" similar to fruit shipping containers widely used in the European market. This crate is basically an open-sided "flat" container secured by girth binding wires wherein the ends of the wire are bent over the top edge of the sides for increased container load strength and personnel security whereas the previously mentioned containers are four-sided, the fourth side being the top.

In fabricating the "flat plateau crate", container blanks are processed as described above on the modified RF equipment to yield a 3-sided flat container blank having loops formed in each of the ends of the girth binding wires. Since these loops are extraneous in the plateau crate they must be manually bent over the side edges of the mats or alternatively they may be cut away using wire cutters. Once the ends have been either cut-off or bent around the side edges of the mats, the flat container blank can be assembled manually by stapling the end sections on or, alternatively, they can be inserted into a semiautomatic plateau assembly machine (SPAM) which attaches the end pieces and results in the finished five-sided plateau crate (i.e. 2 ends, 2 sides and 1 bottom).

Several problems have been encountered in this fabrication process. First, the operation of cutting off or bending over the extraneous looped ends must be done manually. This manual manipulation is both time consuming and potentially hazardous to employees involved in cutting and bending the wires. Also, where the wires are cut off, there is the danger that a subsequent worker may also be injured by the cut ends of the wire as he is handling the container. Further, since the loop formed in the end of the wires is unnecessary for the "plateau"-type box, the excess wire used in forming the loop is totally wasted. When multiplied over several thousand boxes this wasted wire presents a considerable expense. An additional problem which arises is that although the RF Looping Machine works acceptably, it is large, complex and relatively expensive. The complexity tends to result in excessive part breakage and down time making the machine somewhat less attractive in a highly competitive international market.

OBJECTS OF THE INVENTION

Accordingly, it is an object of the present invention to provide an apparatus to replace the modified RF Looping Machine capable of performing the combined operations of cutting, bending, and clinching.

Another object of the present invention is to provide a compact, relatively inexpensive and simply designed apparatus to perform the needed wire manipulations necessary in the fabrication of flat "plateau" crates.

A further object of the present invention is to provide a reliable machine whose parts are structurally sound and capable of withstanding rough use with minimum maintenance.

Another object of the present invention is to provide a wire manipulating machine capable of cutting girth binding wires, bending the ends thereof around the side edge of the adjacent slats and clinching them into the adjacent slats for added carrying capacity and minimized wire projection from the container.

A still further object of the present invention is to provide a wire manipulating mechanism of the character described which is relatively simple and inexpensive in construction but dependable in operation and contributes to the fabrication of a plateau crate which is safe to handle.

SUMMARY OF THE INVENTION

The present invention solves the problems associated with conventional devices and further satisfies the need for an inexpensive, safe, efficient and reliable wire manipulating mechanism for bending the ends of girth binding wires around the side edge mats and terminating the wires by means of a clincher for added carrying capacity and minimized wire projection. The present invention further eliminates the problems and hazards associated with manual manipulation of the cut binding wires by performing the operations of cutting, bending and clinching automatically within the machine.

In accordance with one aspect of the present invention an apparatus for cutting, bending and clinching the ends of girth binding wires on wirebound container blanks is provided wherein wire manipulations are performed on a wire section in the tie wire gap between adjacent mats of the container blank to cut, bend and clinch the end of said wire section into the sides of the adjacent mats. The apparatus has a frame which defines a path of travel therethrough for the container blank and a shuttle means for continuously feeding a catenary of container blanks from a BF stitching machine or supply of container blanks up to a wire manipulating position within the apparatus. A pair of crossbars are respectively vertically reciprocally mounted in the frame and are positioned transverse to the path of travel of the container blank for movement in unison between upper and lower positions. These crossbars are reciprocated vertically in accordance with a predetermined sequence to cut, bend, wipe and clinch the girth binding wires in the interval between the adjacent blanks.

The first of the crossbars is positioned above the path of travel of the container blank and has mounted thereon wire manipulating means including means for cutting the girth binding wire and bending it downward as the first crossbar is moved to its lower position. The second crossbar is connected to said first crossbar and is positioned below the path of travel of the container blank. It has a wire wiping and clinching means mounted thereon such that, as the second crossbar is moved to its upper position, the wiping means engages the previously cut and bent wire sections and wipes them back against the sides of the container blank. As the second crossbar approaches the top of its stroke, the clincher means contacts the wire ends and drives them into the sides of the adjacent mats.

BRIEF DESCRIPTION OF THE DRAWINGS

The above and other objects, features and advantages of this invention, will be apparent in the following detailed description of an illustrative embodiment thereof, especially when taken in conjunction with the accompanying drawings, wherein.

DETAILED DESCRIPTION OF A PREFERRED EMBODIMENT

Figure 1:
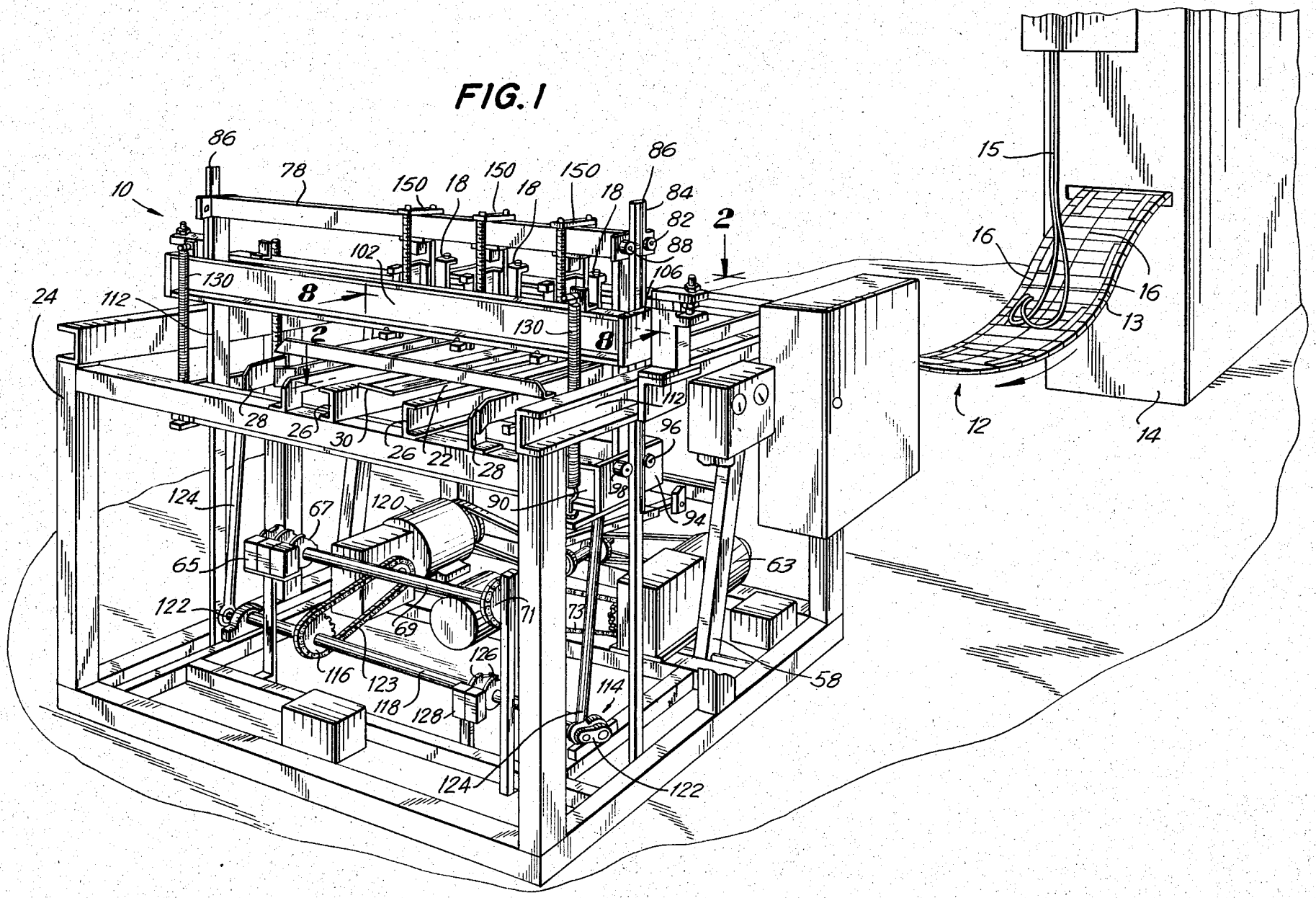
FIG. 1 is a perspective view of a WIRE BEND MACHINE constructed in accordance with one embodiment of the present invention showing the container blanks being fed from a BF stitching machine.

Referring now to the drawings in detail, and initially to FIG. 1 thereof, a WIRE BEND MACHINE 10 is illustrated receiving a continuous succession of wire bound container blanks 12 from a BF stapling machine 14. This catenary of container blanks is regulated by a container blank control 15 which senses the sag of the container blanks coming from the stapling machine 14 to determine if there is sufficient material for the WIRE BEND MACHINE 10 to cycle. This information is then relayed to the machine 10 which either goes ahead with the cycle or shuts down if insufficient blanks are present. As illustrated in the drawing, blanks 12 are composed of individual mats 13 interconnected by a series of girth binding wires 16.

As describe hereinafter, a shuttle system drives the succession of blanks 12 to a predetermined position within the wire bend machine 10 where the binding wires 16 in the tie wire gap between adjacent blanks are properly positioned for manipulating. At this point, movement of the blanks is momentarily stopped and the machine is automatically actuated to cause wire cutter-bender means 18 mounted in the machine in association with each of the wires to sever the binding wires 16 and, in the same stroke, bend the cut wire sections downward. The wiper-clincher mechanism 20, also mounted in the machine in association with each of the wires 16, comes into operation on the reverse stroke to wipe and clinch the cut bent binding wires against the adjacent mats. The cutter-bender mechanisms 18 and the wiper-clincher mechanisms 20, as detailed hereinafter, are uniquely designed so that both ends of the cut wires, i.e., the ends on the leading edge of the incoming blank and on the trailing edge of the outgoing blank, are simultaneously manipulated.

These mechanisms 18, 20 are respectively located above and below the path of travel 22 of the wirebound container blanks 12 and operate together in a timed sequence, such that after the wire 16 has been cut and bent from above and wiped and clinched from below, the shuttle system, described in greater detail hereinafter, is again actuated to move the next container blank into the wire manipulating position and, by so doing contact the trailing edge of the preceding mat forcing it out of the machine.

Figure 2:
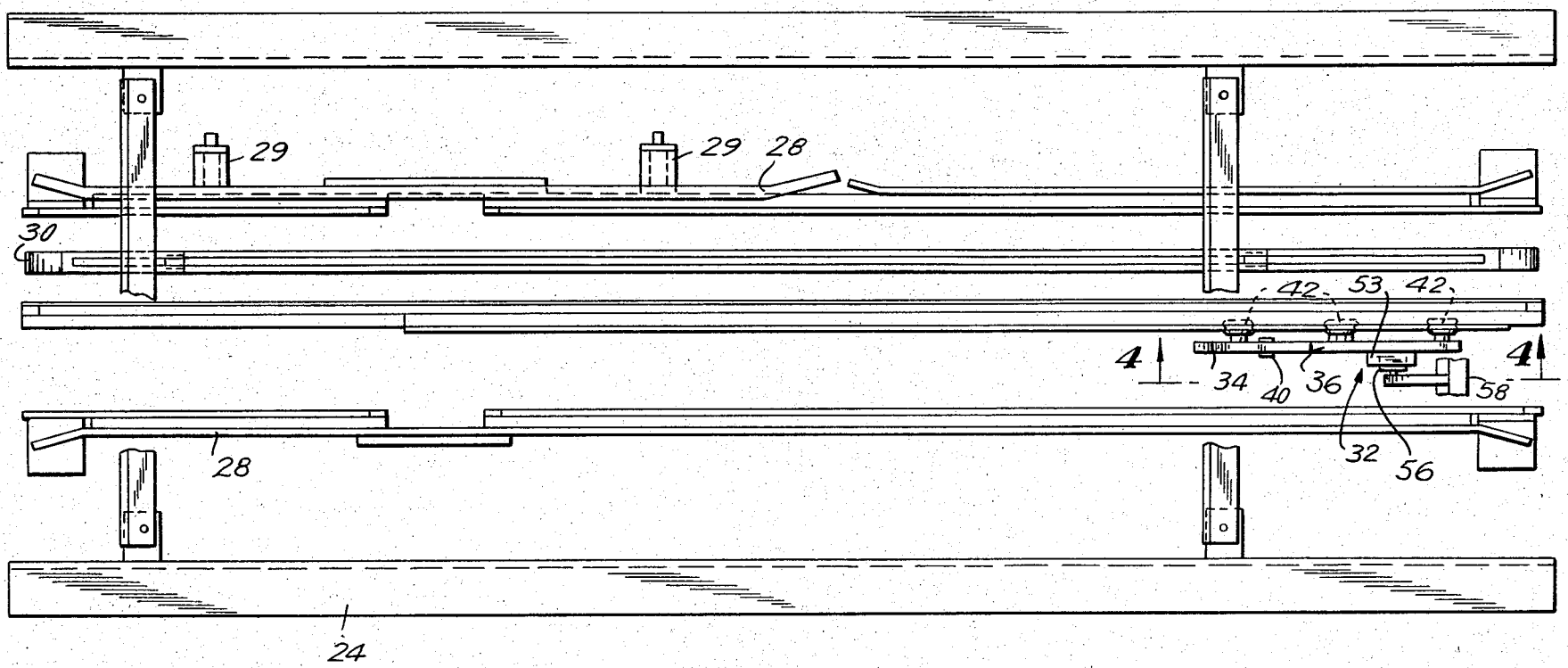
FIG. 2 is a top plan view taken along line 2—2 in FIG. 1 of the stock guides.
Figure 3:
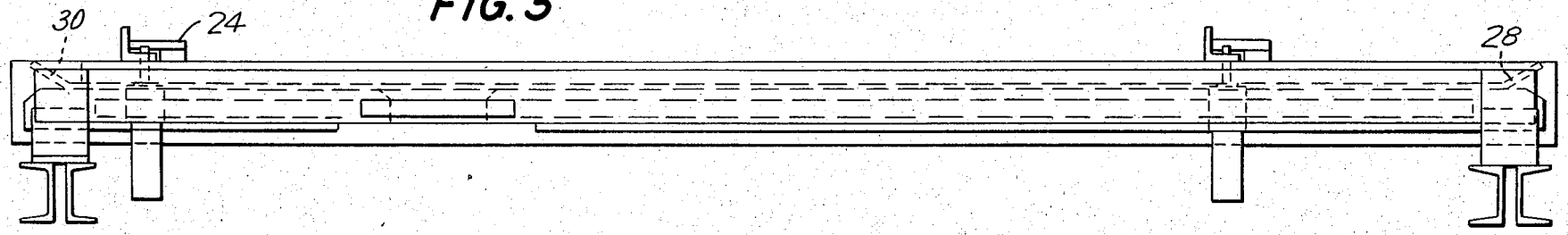
FIG. 3 is a side elevation view of the stock pressers and supports.

WIRE BEND MACHINE 10 includes a frame 24 through which is provided a path of travel 22 for the container blanks 12. This path of travel 22 is formed by two horizontally positioned parallel beams 26 to provide vertical support for the container blanks 12. Guide plates 28 are positioned on either side of the horizontal parallel beams 26 and prevent lateral movement of the container blanks 12 while defining the edges of the path of travel 22. These guide plates 28 are spring loaded at 29 to allow varying widths of container blanks to be admitted. A stock presser 30 is positioned above the path of travel 22 which, in combination with the guide plates, provide sufficient drag to prevent the blank 12 from moving during the wire cutting and manipulation. (FIG. 2 and FIG. 3 illustrate in greater detail the path of travel 22 through the frame 24). Hydraulic air pressers (not shown) are also positioned above and below the path of travel to respectively hold the trailing container blank and the leading container blank securely in position while the binding wires are being manipulated.

Figure 4:
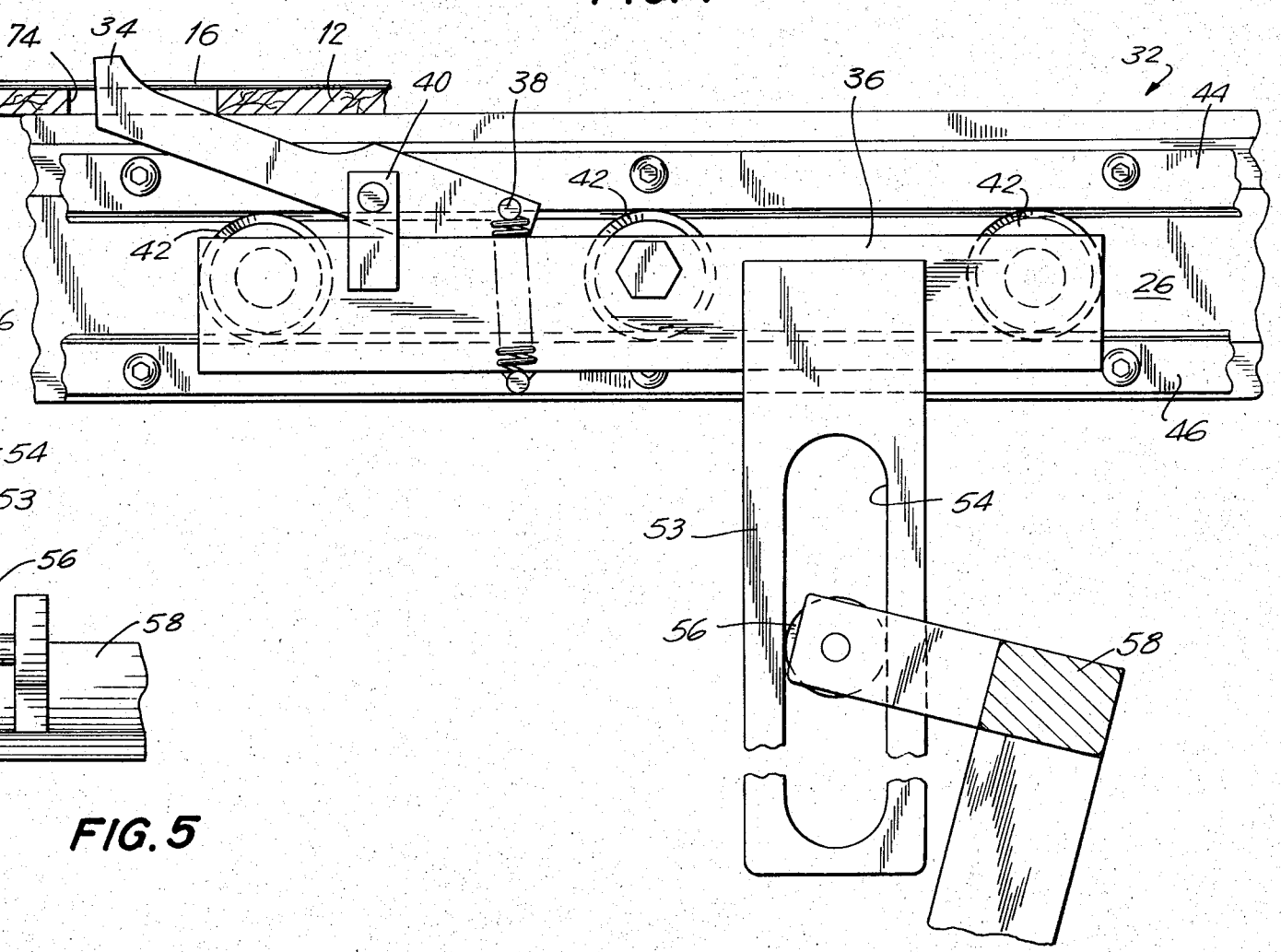
FIG. 4 is an enlarged detailed side elevation view taken along line 4—4 in FIG. 2 of the shuttle dog and the shuttle carriage.
Figure 5:
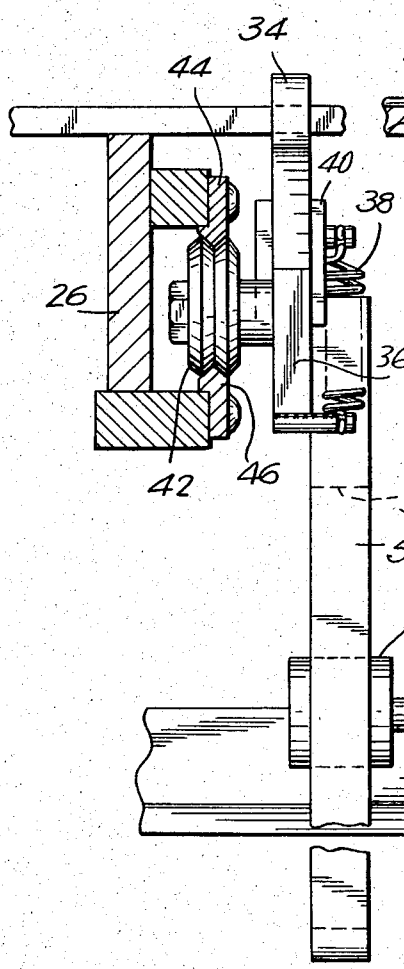
FIG. 5 is an enlarged front elevation view of the shuttle carriage and channel.

Referring now to FIG. 4 and FIG. 5 there is shown the unique shuttle system 32 which reciprocally drives the catenary of container blanks 12 along their path of travel 22 through the WIRE BEND MACHINE 10. This shuttle system comprises a shuttle dog 34 which is fixed to a shuttle carriage 36 by means of a shuttle dog biasing spring 38 and a shuttle pivot 40. The shuttle carriage 36 is moveable horizontally back and forth on carriage rollers 42 which travel within a slot defined by upper and lower channel members 44 and 46 which are in turn fixed to beam 26. Shuttle carriage 36 is driven reciprocally between a first position 48 (shown in FIG. 6) and a second position 50 (shown in FIG. 7) by means of a shuttle linkage 52. This shuttle linkage comprises a vertical rectangular bar 53 having a vertical slot therein 54, a roller 56 moveable vertically within slot 54, an L-shaped shuttle arm 58 pivotally attached to frame 24 at pivot 60 and to roller 56 and a drive means 62 for moving the L-shaped shuttle arm 58 in a reciprocating motion. Shuttle drive means 62 includes a motor 63 (FIG. 1), a drive wheel 64, an adjustable connecting rod 66 connecting a drive link 70 mounted on the circumference of wheel 64 and to the drive pivot 68 attached to the L-shaped shuttle arm 58 between pivot 60 and roller 56.

Figure 6:
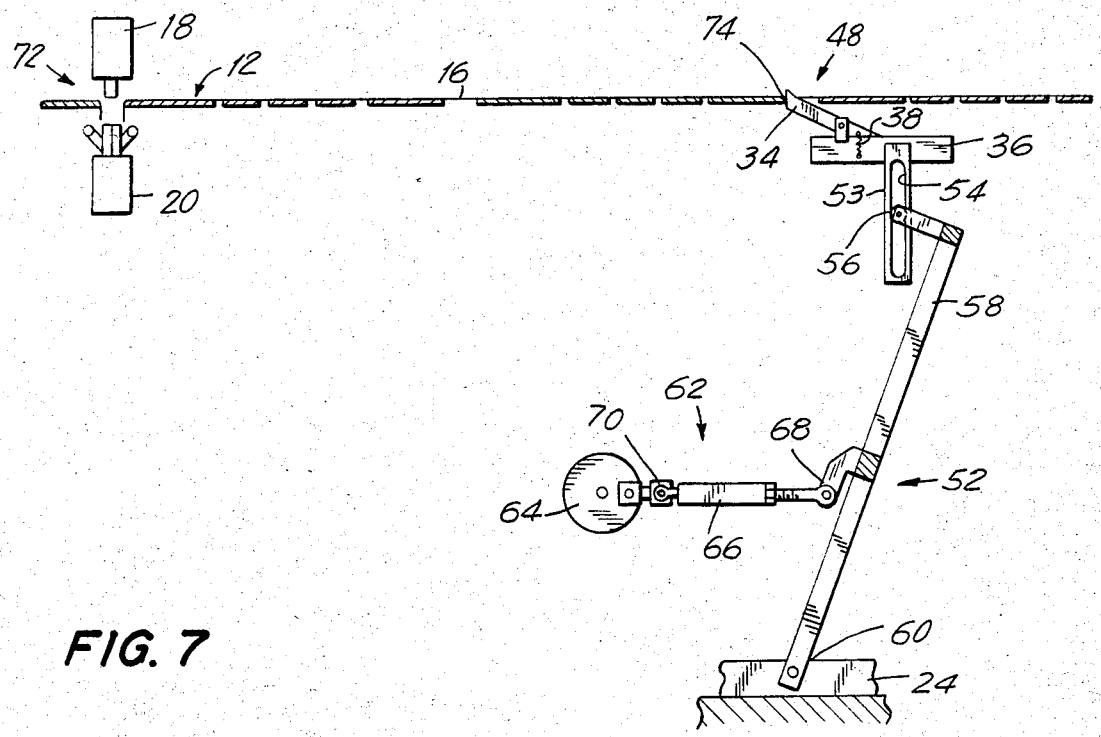
FIG. 6 is a side elevation view of the shuttle and its drive linkage 2, engaging the container blank.
Figure 7:
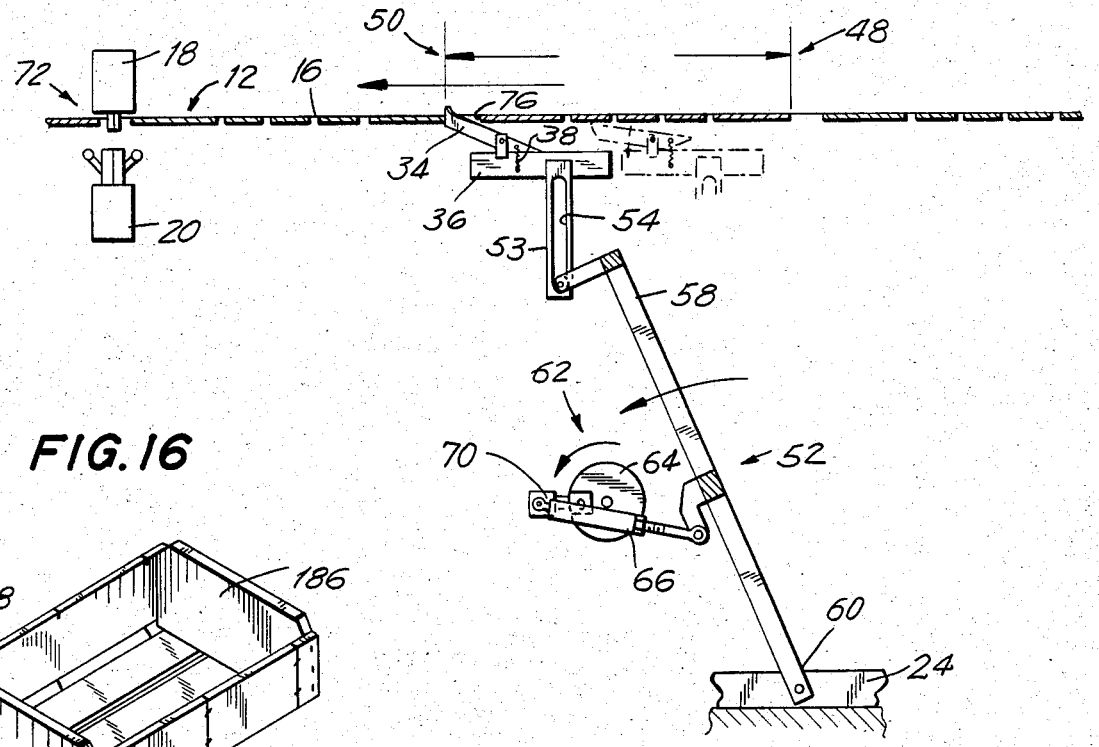
FIG. 7 is a side elevation view of the shuttle and its drive linkage pushing the container blank to the wire manipulating position.
Figure 16:
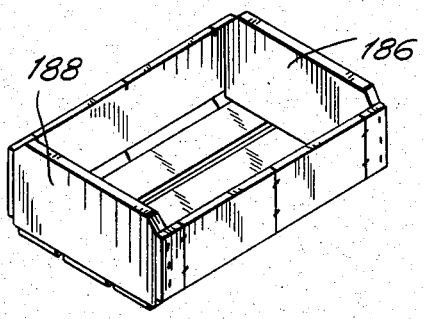
FIG. 16 is a perspective view of a completed five-sided plateau crate.

As illustrated in FIG. 7, counterclockwise rotation of said motor drive wheel 64 is converted into reciprocating translational motion of the L-shaped shuttle arm 58 causing shuttle dog 34, mounted on the shuttle carriage 36, to contact the trailing edge of a container blank 74 to move the blank from a first position 48 (as illustrated in FIG. 6) to a second position 50 (as indicated in FIG. 7) thus locating the tie wire gap in a wire manipulating position 72 wherein the wire 16 can be cut, bent, wiped and clinched by the cutter-bender mechanism 18 and the wiper-clincher mechanism 20. As these operations are completed, drive wheel 64 continues to cycle by rotating in the counterclockwise direction driving the shuttle carriage 36 back to its first position 48 to continue the process. In returning to its first position, shuttle dog 34 is forced to pivot downward by the leading edge of the next succeeding container mat 76. This allows shuttle dog 34 to pass beneath the succeeding container blanks 12 (this motion shown in phantom in FIG. 7) and to pivot upward into the succeeding tie wire gap when the shuttle carriage 36 has returned to its first position 48.

Sequential control of the shuttle system 32 is provided by switches 65 (see FIG. 1) activated by cams 67 which are mounted on shaft 69. This shaft is driven by gear 71 which is rotated through chain 73 by wheel 64. These switches control the reciprocal motion of the shuttle dog 34 between a first and second position.

Figure 8:
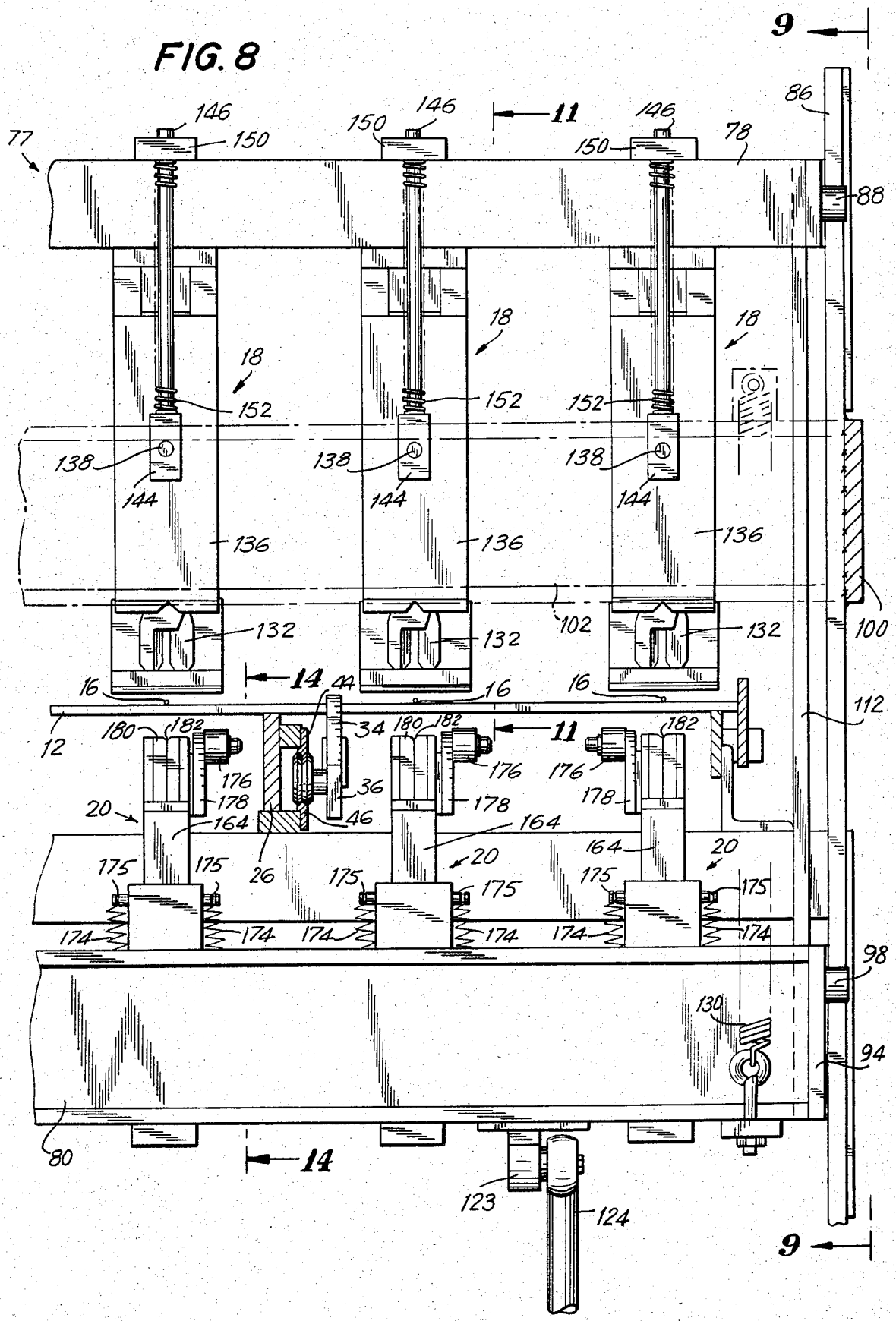
FIG. 8 is an enlarged front elevation view in section taken along line 8—8 in FIG. 1 of the cutter bender apparatus and the wiper clincher apparatus mounted in the carriage assembly.
Figure 9:
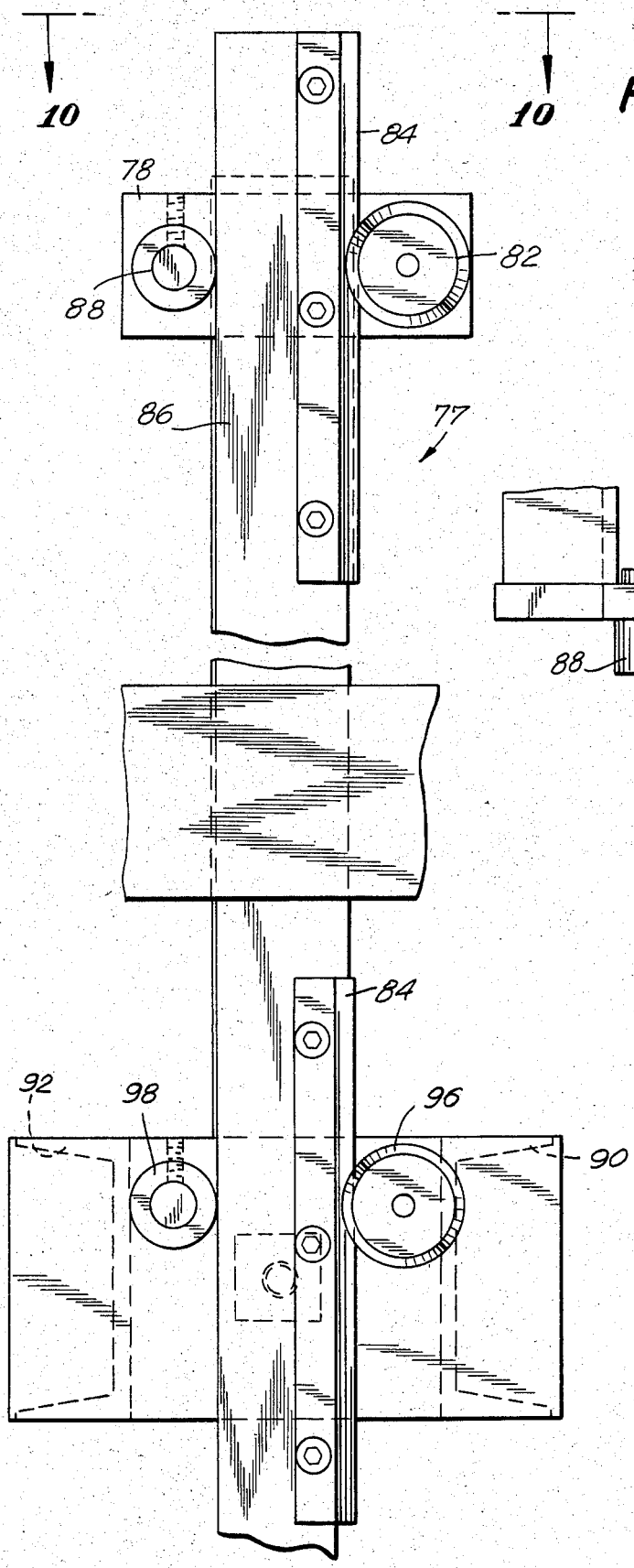
FIG. 9 is an enlarged side elevation view in section taken along line 9—9 in FIG. 8 of the crossbar guide members.
Figure 10:
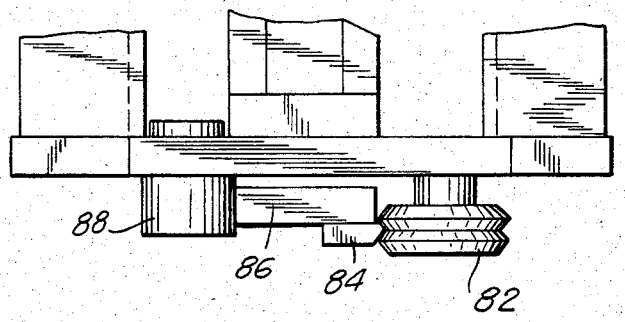
FIG. 10 is a top plan view in section taken along line 10—10 in FIG. 9 of the crossbar guide members.

Also mounted within frame 24 of the WIRE BEND MACHINE 10 is a wire manipulating means carriage assembly 77 (FIG. 8) comprising two horizontal transversely extending cross beams or bars 78, 80 which are connected by vertical joining members 112 for simultaneous vertical reciprocal movement to effect the operation of the cutter-bender mechanisms 18 and the wiper clincher mechanisms 20 respectively. As seen in FIG. 8 and FIG. 9 the first of these crossbars 78 consists of a rectangular beam having rollers 82 rotatably mounted at its ends in a vertical track 84 formed in guide member 86. A retaining roller 88 is mounted on the end of said first crossbar 78 opposite the beam roller 82 and positioned to contact the leading edge of the guide member 86 opposite vertical track 84. This retaining roller 88 serves to maintain beam roller 82 within the vertical track 84 and allows for the free vertical movement of said first crossbar 78. (It is noted that although FIG. 8 and FIG. 9 illustrates only the right hand portion of the machine, the structure shown therein is duplicated at the left hand portion of the machine except as otherwise noted hereinafter) The first crossbar 78 has mounted thereon three cutter bender mechanisms 18 positioned so as to address each of the girth binding wires 16 in unison. A detailed description of the construction and operation of the unique wire cutter-bender mechanism will appear below. When the container blanks 12 are in their proper position, the wire manipulating means carriage assembly 77 is lowered to activate the cutter-bender mechanisms with respect to the container blank and binding wire thereon.

Crossbar 80 is vertically reciprocally mounted within frame 24 below the path of travel 22 of the container blanks 12. This crossbar 80 consists essentially of an elongated box-like structure having two beam sections 90 and 92 interconnected at their ends by crossplates 94, 94'. The three wiper clincher mechanisms 20 are mounted within beam sections 90 and 92 in position to address each of the girth binding wires 16 and the container blank 12 as the carriage assembly 77 is driven upward in the second half of its cycle. End plates 94, 94' carry rollers 96 thereon which are received in the vertical tracks 84 mounted on the lower ends of guide members 86, 86'. Retaining roller 98 is also mounted on crossplate 94 opposite roller 96 and in contact with the leading edge of guide member 86, so as to maintain roller 96 on vertical track 84 and allow for the free vertical movement of the second crossbar 80 in unison with first crossbar 78. A third horizontal crossbar is fixed at its ends to the guide members 86, 86' transverse and above the path of travel 22 of the container blank 12 and in the interval between said first crossbar 78 and second crossbar 80. This third horizontal crossbar 100 is stationary within frame 24 and comprises two beam sections 102, 104 fixed to the front and rear respectively of the guide members 86 and a crossplate 106 on either end. This crossbar 100 serves as a base for the cutter-bender activating mechanisms and the clincher backup plates 110 (discussed in greater detail below).

As previously mentioned, the first and second horizonal crossbars 78, 80 are joined together by joining members 112, 112' such that the two crossbars and the wire manipulating mechanisms mounted thereon operate in unison. This carriage assembly 77 is reciprocated vertically by a linkage mechanism 114 (FIG. 1) which includes a gear 116 mounted on a main drive shaft 118 and driven by a motor 120 through chain 123. Mounted on both ends of shaft 118 are rotatable crank linkages 122, 122'. The carriage assembly 77 is pivotally connected to rotatable linkages 122 by means of drive arms 124 which attach to the underside of second horizontal crossbar 80 at pivot 123 (FIG. 8). The rotational motion of drive shaft 118 is thereby converted into vertical reciprocation of the carriage assembly 77 driving it between a first position and second position.

Also mounted on shaft 118 are two cams 126. These cams are positioned so as to contact switches 128 which in turn control the upward and downward movement of the carriage assembly 77. As mentioned above, and as seen in FIG. 1, the drive mechanism for the carriage assembly is duplicated on the left side of the machine for simultaneously driving the opposite end of said second crossbar 80.

In operation, the carriage assembly 77 is maintained in its neutral position by biasing springs 130 which connect the second crossbar 80 to the third fixed crossbar 102. Assuming adequate catenary of container blanks exists, (as sensed by the container blank control 15) the shuttle system 32 previously described is activated by switches 67 to drive the container blanks 12 along the path of travel 22 to the wire manipulating position 72. The container blank is maintained in this position by means of pressers 30, guide members 28 and support beams 26. Once stationary in the wire manipulating position 72, the linkage mechanism 114 controlling the vertical reciprocation of the carriage assembly 77 is activated. Shaft 118 rotates causing the carriage assembly to move downward and bring the cutter bender mechanism 18 into position to cut the girth binding wires 16 connecting the container blanks 12 in the tie wire gap between adjacent blanks. Approximately halfway through the downward stroke of the carriage assembly, the cutter-bender apparatus surrounds and cuts the girth binding wires 16. The carriage then continues downward causing the bender portion of the mechanism 18 to bend said girth binding wires approximately 90° downward.

Once the carriage assembly 77 reaches the bottom of its cycle, rotatable crank linkage 122 causes shaft 118 to reverse and drive the carriage assembly upward. As this occurs, hydraulic air pressers engage the trailing container blank and hold it securely for the wiping and clinching operation. In the course of the upward stroke, the previously cut and bent girth binding wires 16 are wiped back against the adjacent sides of the container blank and, near the top of the cycle, the wiped girth binding wires are clinched into the side walls of the container blank. When the full cycle has completed the carriage assembly 77 is returned to its neutral position and the shuttle system 32 is again activated to engage the succeeding container blank and, at the same time, contacting the back edge of the previous container blank, forcing same out of the WIRE BEND MACHINE.

Referring now to FIG. 11, FIG. 12, and FIG. 13A through FIG. 13C of the drawings, one of the unique wire cutter-bender mechanisms 18 is sequentially illustrated in greater detail. As mentioned, one of these mechanisms is arranged in the carriage assembly 77 on first horizontal crossbar 78 in association with each of the girth binding wires 16 passing through the machine. (Thus, as shown in FIG. 1 where the catenary of the container blanks 12 has three wires, three of these cutter-bender mechanisms are mounted on the first horizontal crossbar 78). The wire cutter-bender mechanisms 18 are individually adjustably mounted on crossbar 78 by means of a mounting bar 150 in order to allow the relative positions of these mechanisms to be varied in accordance with the type and dimension of wire bound container blanks being processed.

Each of these novel cutter-bender-mechanisms comprises a set of parallel cutter blades 132 retractably mounted in a cutter body 134 and, a set of wedge-shaped cutter guide plates 136 mounted to the cutter body 134 parallel to said cutter blades 132. The cutter body 134 and the guide plates 136 are fixed in a plane perpendicularly transverse to the plane of the path of travel 22 of the container blanks. A cutter pivot pin 138 connects the cutter blades 132 and extends through vertical slot 140 in the cutter guide plates 136 to allow the cutter blades 132 to extend and retract within the cutter body 134.

Figure 11:
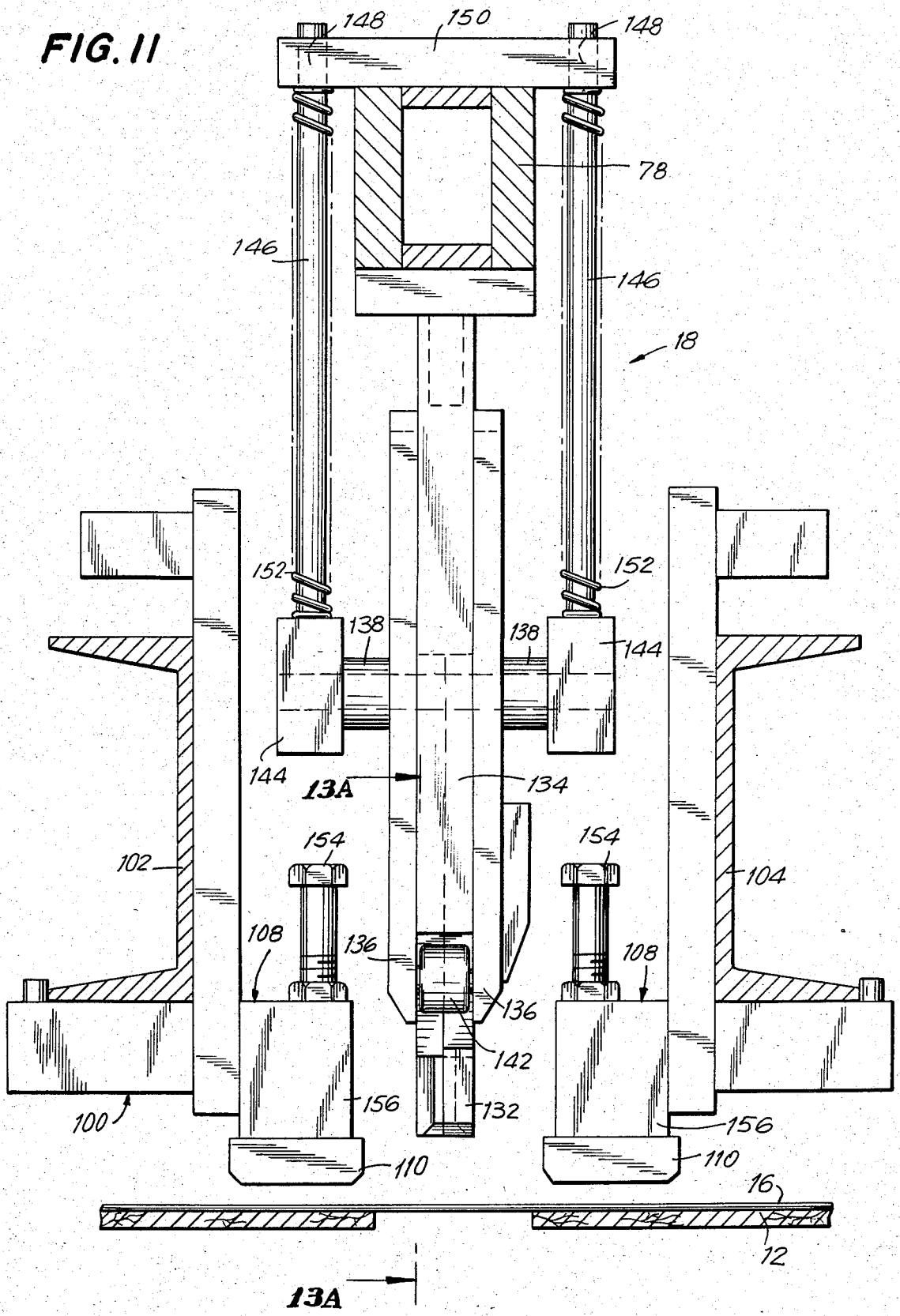
FIG. 11 is an enlarged side elevation view taken along line 11—11 in FIG. 8 showing the cutter-bender in its neutral position.

A set of cutter biasing rollers 142 is rotatably mounted at the mouth of the chamber into which the parallel cutter blades 132 retract such that, when the mechanism 18 is in its neutral position, the parallel blades 132 are extended and biased apart by said rollers 142. (This configuration is best illustrated in FIG. 13A) A set of cutter stop blocks 144 is positioned at either end of the cutter pivot pin 138 and serve as drive mechanisms for the cutter blades. These blocks 144 each have a guide rod 146 vertically mounted perpendicular to pivot pin 138 and slideably passing through guide holes 148 in cutter-bender mounting block 150. Cutter-bender assembly mounting block 150 is adjustably mounted to first crossbar 78. Biasing springs 152 encircle the cutter guide rods 146 and are bounded by the cutter stop block 144 on their lower end and the cutter-bender mounting block 150 on their upper end. These springs 152 maintain the cutter-bender assembly 18 in its neutral position (as shown in FIG. 11) with cutter blades 132 fully extended and maintained apart by biasing rollers 142. The cutter-bender mechanism 18 is activated within the space between beams 102 and 104 of the third fixed horizontal crossbar 100 by means of a set of cutter stop bolts 154 vertically threaded into blocks 156. These blocks 156 are mounted on the inside of the third fixed horizontal crossbar 100 (as shown in FIG. 11 and FIG. 12) in vertical alignment with the cutter stop blocks 144.

Figure 12:
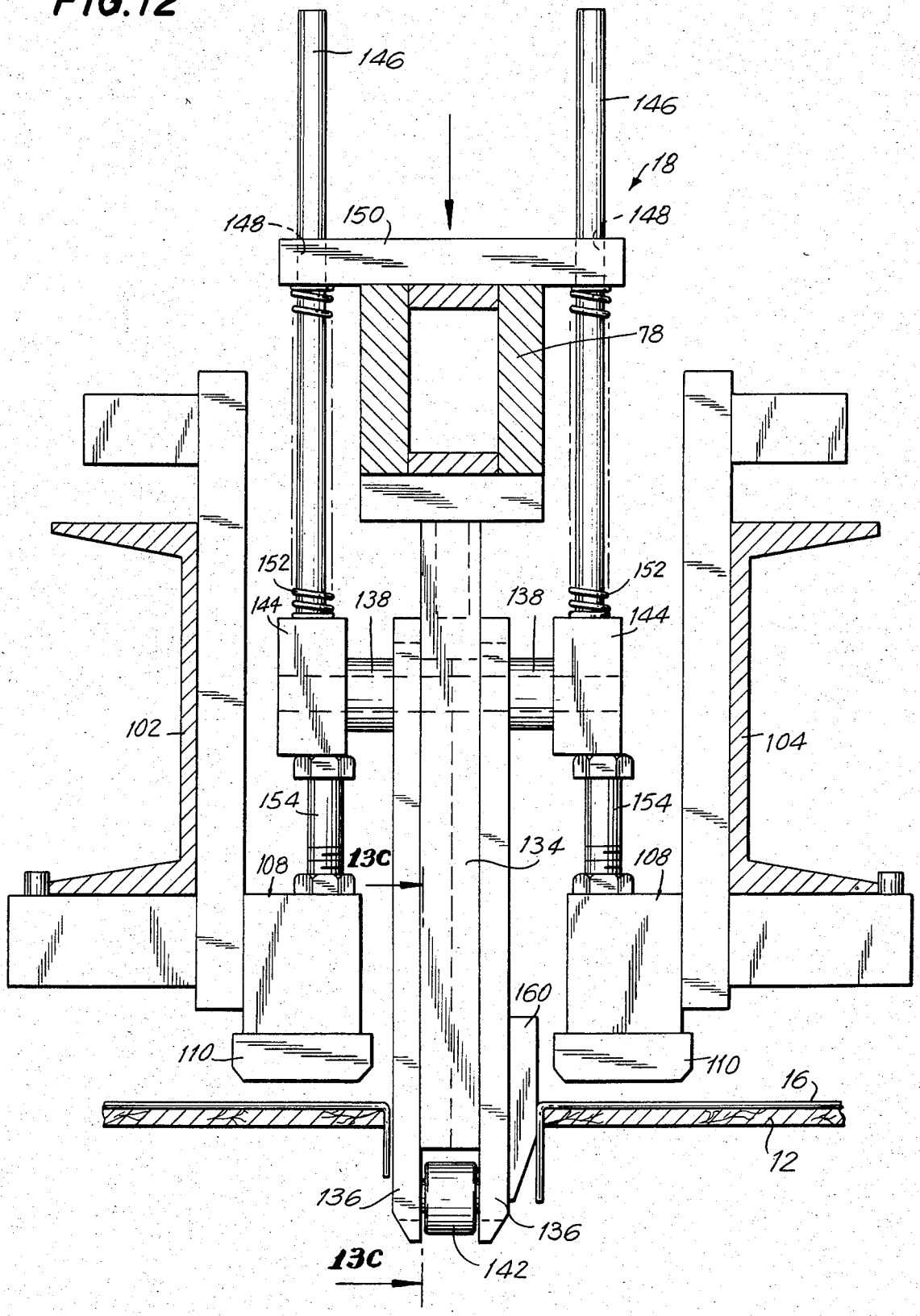
FIG. 12 is an enlarged side elevation view showing the cutter-bender after having completed its operation of cutting and bending the wire section.

The neutral and final bending positions of the wire cutter-bender mechanism 18 are illustrated in FIG. 11 and FIG. 12 respectively. In FIG. 11 there is shown a side view of a cutter-bender mechanism in its neutral position above the girth binding wire 16 and container blank 12. The machine 10 is activated and the linkage mechanism 114 begins the downward stroke of the carriage assembly 77 to engage the cutter-bender mechanisms mounted thereon. The cutter stop bolts 154 are positioned within the third horizontal crossbar 100 such that as the cutter-bender mechanism 18 passes through the interval between the beams of the third crossbar, the cutter stop blocks 144 contact the cutter stop bolts at a point where the cutter blades 132 straddle the girth binding wires 16. (It is of note here that by varying the vertical stop screw adjustments by one-eight of an inch, the cutoff points for the girth binding wires are staggered, thus reducing the total force required to cut the wires). At this point, the downward motion of the cutter blades 132 is halted by the cutter stop blocks 144 and the biasing springs 152 begin to compress as the first crossbar 78 continues to drive the cutter body 134 and the cutter guide plates 136 downward relative to blades 132 to the lower position of the downward stroke.

Figure 13C:
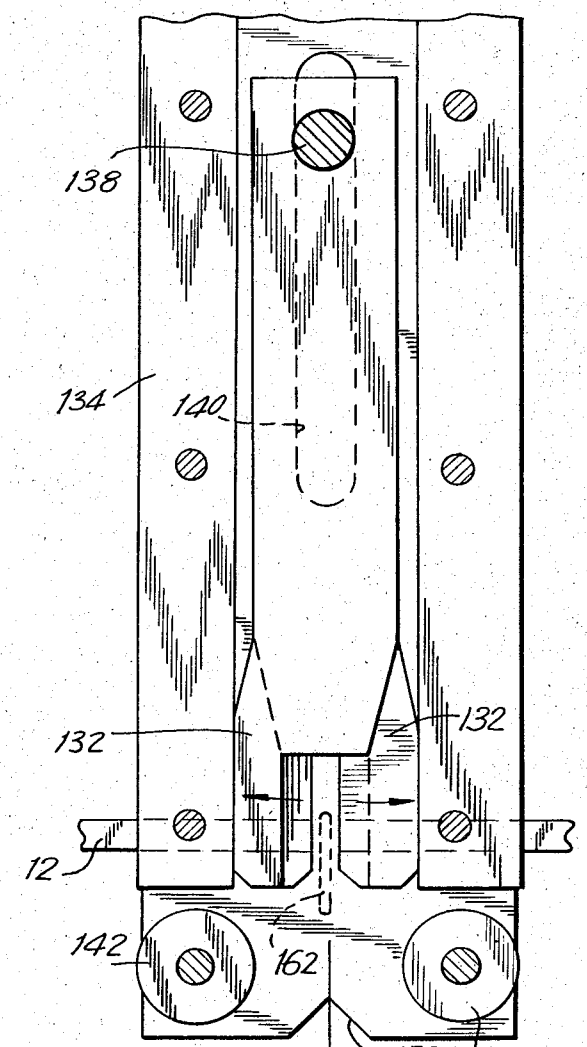
FIG. 13C is an enlarged front elevation view in section taken along line 13C—13C in FIG. 12 showing the cutter-bender in its bending operation with cutter blades retracted and apart.
Figure 13B:
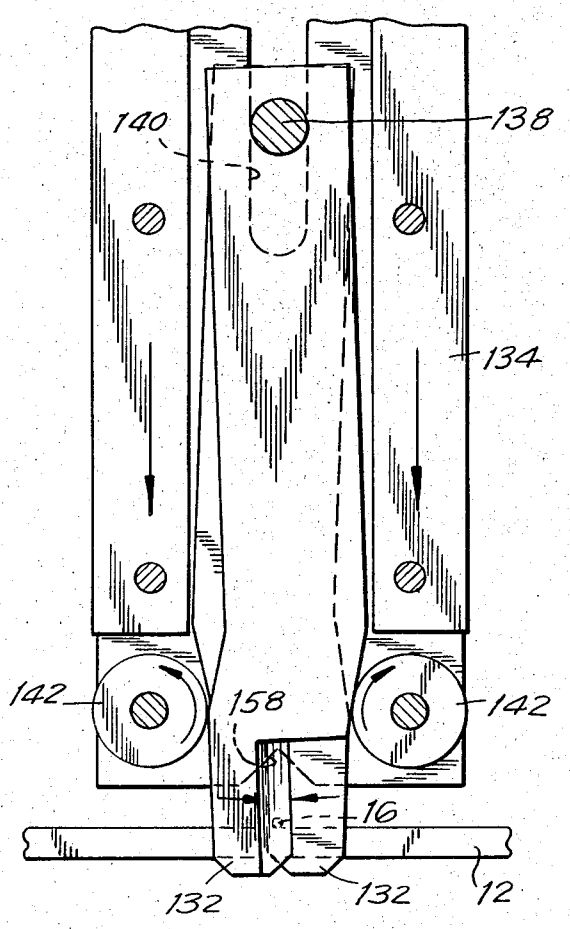
FIG. 13B is an enlarged front elevation view in section of the cutter-bender after having completed it wire cutting operation.
Figure 13A:
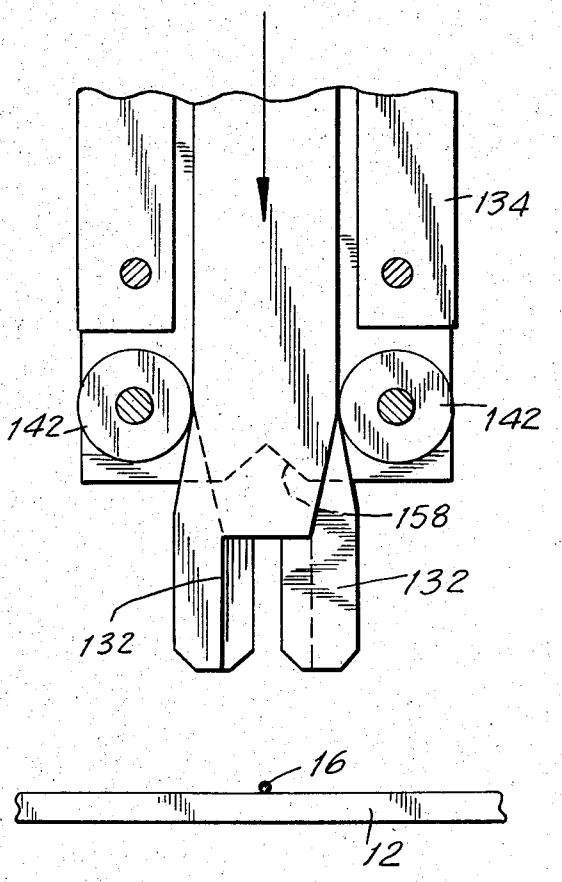
FIG. 13A is an enlarged front elevation view in section taken along line 13A—13A in FIG. 11 showing the cutter-bender in its rest position with blades apart.

FIGS. 13A–13C show a cutaway illustration of the sequence of operation of the cutter blades 132. As illustrated in FIG. 13B, the downward motion of the cutter body 134 and the cam surface on the cutter blades 132 force the cutter blades together as said blades are driven inward relative to the rollers, thus severing the girth binding wires 16. Once the binding wires 16 are severed, the carriage assembly 77 continues to drive the cutter body 134 and the cutter guide plates 136 attached thereto downward to engage the cut binding wire section in notches 158 in guide plates 136. (The cutter guide plates are attached on either side of the cutter blades 132 such that wire manipulations may be performed to both sides of the cut wire 16 simultaneously). As the carriage assembly 77 continues the downward cycle of the cutter body 134 and the cutter guide plates 136, both sides of the cut binding wire are simultaneously bent downward approximately 90° by the wedged shaped cutter plates. Fixed to the back of the cutter guide plate is a supplementary wedge 160 which repositions the leading edge of the succeeding container mat as the cut wires are bent. This insures proper alignment of the succeeding container blanks and allows for proper wiping and clinching. FIG. 12 and FIG. 13 illustrate the cutter-bender mechanism 18 at the lower end of the cycle with cutter blades 132 fully retracted after having cut and bent the girth binding wire 16 in the interval between adjacent container blanks.

Once the downward stroke of linkage mechanism 114 is completed the rotatable crank linkage 122 continues to be driven around thus forcing the carriage assembly 77 back upward by means of drive arms 124. During this upward stroke of the cycle, the unique wiper clincher mechanism 20 engages the cut bent wire sections 162 and simultaneously wipes those wire sections against the adjacent sides of the container blank and clinches them into the sides of the blank. This wiper-clincher mechanism 20 is fixed within the space between beam sections 90 and 92 of the second horizontal crossbar 80. Wiping is accomplished by means of two wiping arms 164 (FIG. 14) retractably mounted within the chamber formed by the vertical clincher supports 166 and the bender guide plates 168. Each of the wiping arms 164 is extended and retracted within the mechanism by means of mounting cams 172 which ride within a symmetrical arch-shaped slots 170. In their neutral position, wiping arms 164 are maintained extended and in an inverted "V" configuration by biasing springs 174. These biasing springs 174 attach to the lowermost cam 172 and to fixed pins 176 on the bender guide plates 168.

Figure 17:
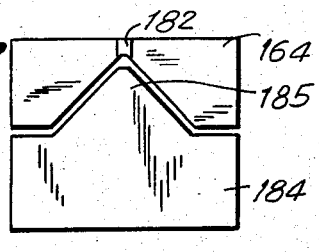
FIG. 17 is a top plan view of the clincher anvil meshing with the wiper arm.

A contact roller 176 is angularly attached to the upper portion of the wiper arm 164 by means of a roller arm 178. These contact rollers 176 are positioned such that, during the upward stroke of the assembly 77, the rollers come in contact with the bottom side of the adjacent container blanks 12 driving them upward until they contact the clincher backup plates 110 mounted, as previously described to block 156 in the third fixed horizontal crossbar 100. The rollers 176 remain in contact with the bottom edge of the container blank 12 in order to help hold it securely in position during the wiper-clincher operation. Each wiper arm 164 has vertical V-shaped channel 180 cut therein to engage the cut bent wire sections 162. There is also a small V-shaped notch cut into the end of said wiper arm 164 (best seen at 182 in FIG. 8 and FIG. 17). These V-shaped vertical channels 180 and V-shaped horizontal notches 182 allow for the proper engaging, holding and wiping of the cut wire sections 162 as the wiper-clincher mechanism 20 performs its manipulations. The clinching operation is performed by clincher anvils 184 mounted atop the vertical clincher supports 166. These clincher anvils 184 are shaped as shown in FIG. 17, such that when the wiper arms 164 are fully retracted and parallel, the triangular portion 185 of the anvil 184 meshes with the V-shaped vertical channels 180 in the wiper arm 164. (This meshing is clearly indicated at FIG. 15 and FIG. 17).

Figure 14:
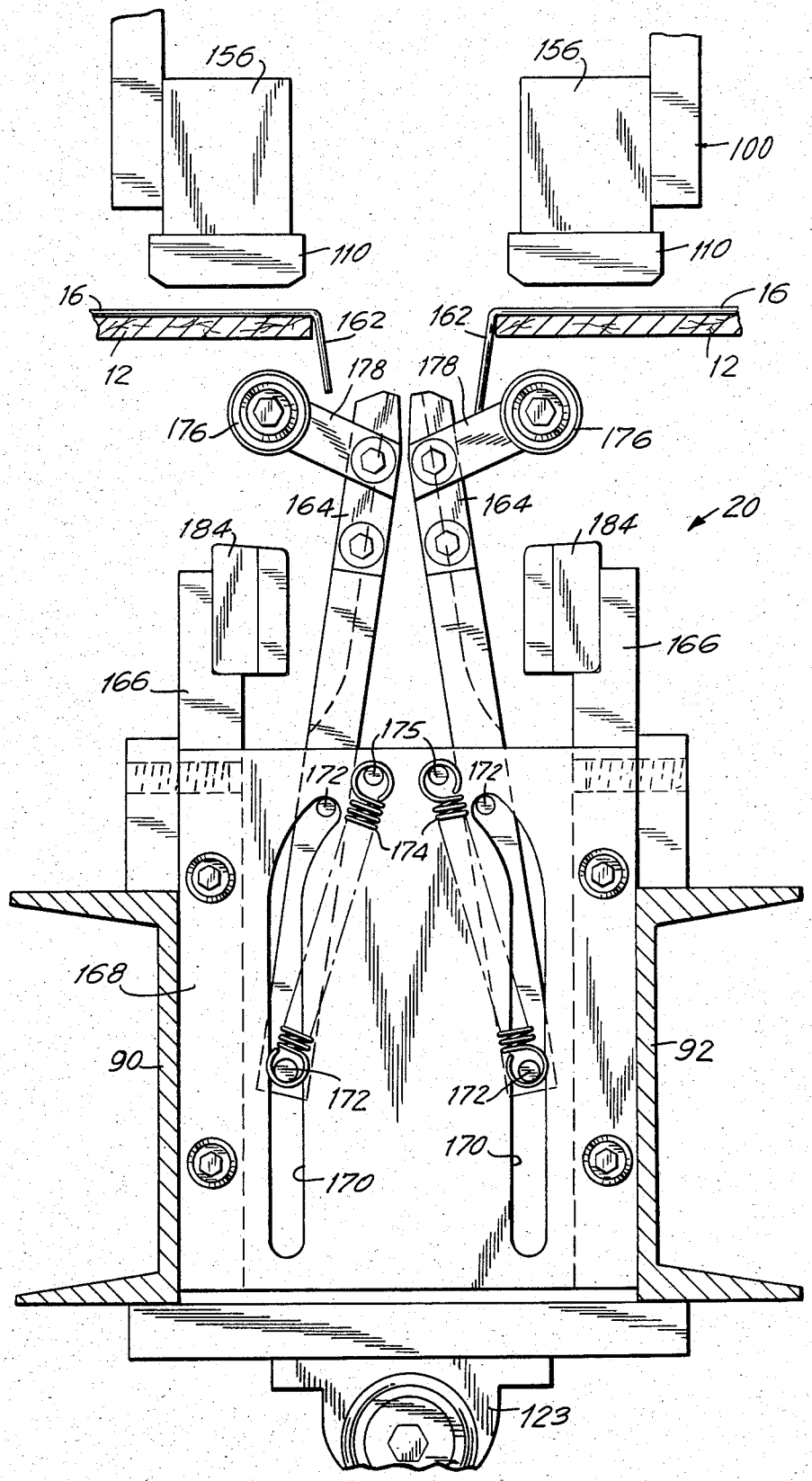
FIG. 14 is an enlarged side elevation view taken along line 14—14 of FIG. 8 of the wiper-clincher in its rest position.

Referring now to FIG. 14, there is shown the wiper clincher mechanism indicated generally at 20 in its neutral position just prior to engaging the bottom of the container blank 12 and the cut bent binding wires 162.

The wiping and clinching operation begins when the carriage assembly 77 is driven upward by the second stroke of linkage mechanism 114. As the wiper-clincher mechanism moves up contact rollers 176 contact and push the adjacent sides of the container blanks 12 up against their respective clincher backup plates 110. As the upward stroke continues, wiper arms 164 are forced to retract by the pressure exerted on them by the contact rollers 176 through the roller arms 178. The wiper arms retract relative to the beam 100 along the symmetrical arch shaped slots 170 in the bender guide plates 168. This retracting motion causes the wiper arms 164 to move apart, effectively engaging the adjacent cut wire sections 162 within the V-shaped vertical channels 180 cut in the ends of wiper arms 164. The continued upward motion of the carriage assembly 77 drives the wiper arms horizontally apart from their centerline along arch-shaped slots 170 causing the bent cut wire sections 162 to be captured within the V-shaped horizontal notches 182 in the top of wiper arm 164 effectively holding and wiping said bent wire sections 162 back against the side of the container blanks 12. As the carriage assembly reaches the upper limit of its stroke, the cut wire sections 162 are held firmly within the V-shaped notch 182 at the top of the wiper arms 164 and against the side of the container blank 12. The clincher anvil 184 rises up simultaneously to engage the end of the cut wire section and drive it into the side of the container blank.

Figure 15:
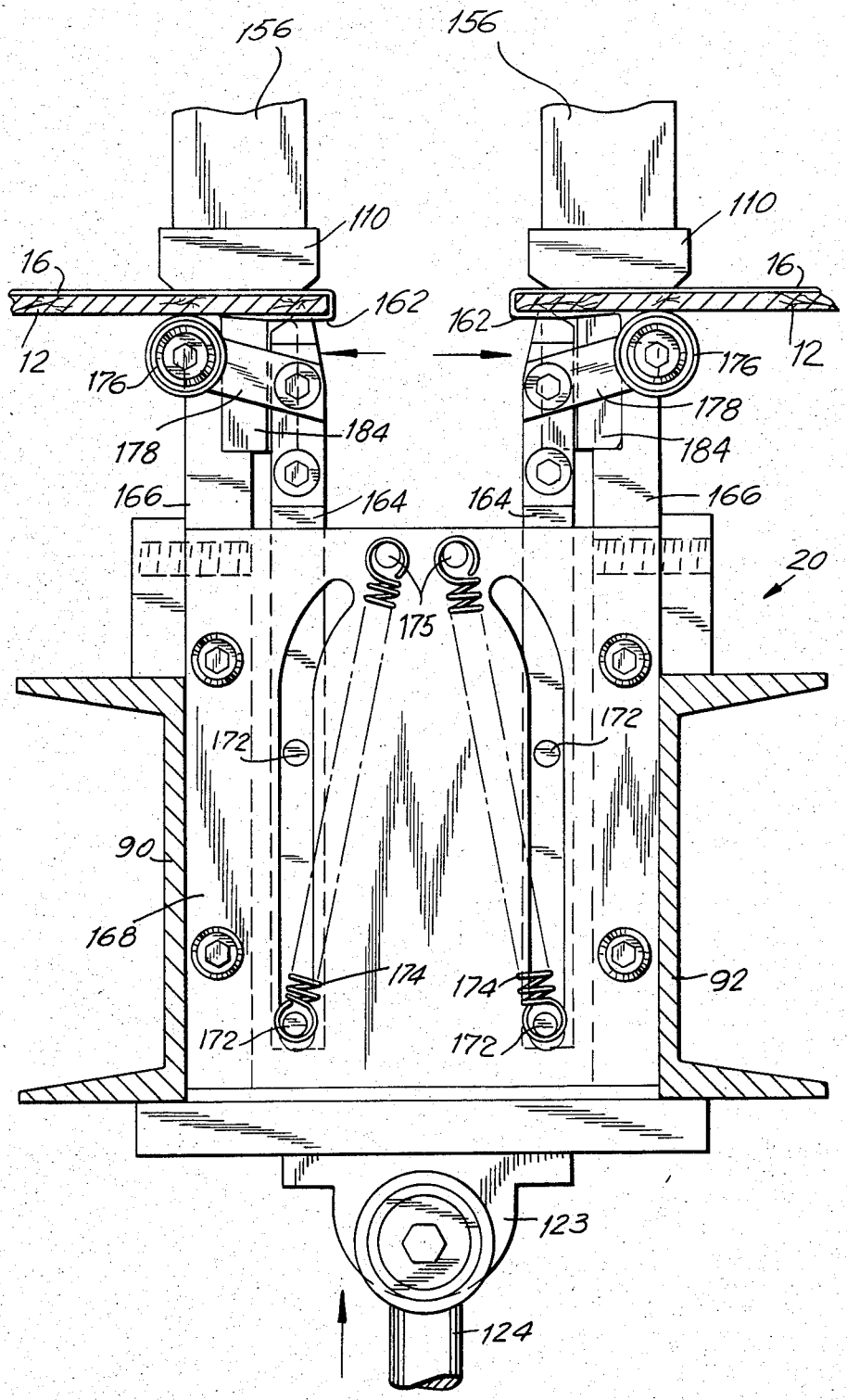
FIG. 15 is an enlarged side elevation view of the wiper-clincher after having completed its operation of wiping the cut wire section and clinching it into the side of the container blank.

As best illustrated in FIG. 15, when the actual clinching is performed, the triangular portion of the clincher anvil 185 meshes with the V-shaped vertical channel 180 in wiper arms 164. When the clinching operation is complete, the linkage mechanism 114 drives the carriage assembly 77 back to their neutral position to await the activation of the shuttle system 32 to feed the succeeding container blank 12 by the wire manipulating position.

Although a particular illustrative embodiment of the present invention has been described herein with reference to the accompanying drawings, the present invention is not limited to this particular embodiment. Various changes and modifications may be made thereto by those skilled in the art without departing from the spirit or scope of the invention, which is defined by the appended claims.

What is claimed is:

1. Apparatus for processing a series of sequentially arranged container blanks each having a plurality of sequentially arranged spaced mats, said blanks having gaps therebetween and being connected by a plurality of binding wires, said blanks having first and second sides and end edges facing each other at said gaps, said wires being located along said first side thereof; said apparatus comprising a frame defining a path of travel therethrough for the container blanks, means for driving said container blanks along the path of travel to a wire manipulating position, and for stopping movement of the blanks with a gap therebetween at said wire manipulating position, means for cutting the binding wires at said gap in the wire manipulating position to form cut wire sections, means for bending the cut wire sections through 90° perpendicular to the first side of the blanks and over said facing edges thereof; means for wiping the thus bent cut wire sections through another 90° bend toward and generally parallel to the second side of its associated mat, and means for clinching the bent cut wire sections into the second sides of their associated mats.

2. Apparatus as defined in claim 1 wherein said means for feeding the container blank is a shuttle system comprising a shuttle dog and a means for moving said shuttle dog between a first position and a second position.

3. Apparatus as defined in claim 2 wherein said shuttle system comprises a pivotally mounted shuttle dog, a shuttle carriage having said shuttle dog mounted thereon, and means for moving said shuttle carriage reciprocally between said first position and said position along the track.

4. Apparatus as defined in claim 2 wherein said means for moving said shuttle dog between a first and second position comprises a shuttle carriage adapted to carry said shuttle dog horizontally parallel to the path of travel of the container blank, a horizontal track guiding said shuttle carriage and a reciprocating means for moving said shuttle carriage between said first position and said second position along said track.

5. Apparatus as defined in claim 4 wherein said reciprocating means comprises a shuttle linkage connected to said shuttle carriage, and a drive means for moving said shuttle linkage reciprocally.

6. Apparatus as defined in claim 1 wherein said means for cutting the binding wires comprises a pair of cutter blades, means for positioning said blades in cutting position around said binding wires, and means for biasing the blades together to cut said binding wires.

7. Apparatus as defined in claim 6 wherein said means for positioning said blades comprises a crossbar having said blades mounted thereon, said crossbar being moveable between a first neutral position and a second cutting position and means for driving said crossbar between said first and second positions.

8. Apparatus as defined in claim 7 wherein said crossbar is positioned above and horizontally transverse to the path of travel of the container blank and cycles substantially vertically between an upper first position and a lower second position.

9. Apparatus as defined in claim 6 wherein said means for biasing the blades together comprises a cutter body retractably housing said cutter blades, a set of rollers fixed within the cutter body which close the blades as they retract within said body and means for retracting said cutter blades.

10. Apparatus as defined in claim 1 wherein said means for bending the cut wire sections includes a wedge and means for driving said wedge between a first neutral position and second bending position.

11. Apparatus as defined in claim 10 wherein said driving means comprises a crossbar having said wedge mounted thereon and moveable between a first neutral position and a second bending position, a driving linkage connected to said crossbar, and means for moving said linkage to drive the crossbar between a first and second position.

12. Apparatus as defined in claim 1 wherein said bending means is mounted on said cutting means in a position to bend said binding wires after they have been cut.

13. Apparatus as defined in claim 1 wherein said wiping means comprises, a wiping arm, means for engaging said cut wire sections with said wiping arm and means for driving said wiping arm to wipe the wire sections against the second sides of their adjacent container mat.

14. Apparatus as defined in claim 1 wherein said wiping means comprises a wiping arm, a means for engaging said bent wire sections and said wiping arm and said means for driving said wiping arm to wipe the wire sections against the second sides of their adjacent container mat.

15. Apparatus as defined in claim 1 wherein said clinching means comprises an anvil and means for driving said anvil against said cut and wiped binding wire to embed it into an adjacent mat.

16. Apparatus as defined in claim 15 wherein said driving means is a crossbar moveable between a first and second position and means for driving said crossbar between said first and second position.

17. Apparatus as defined in claim 16 wherein said crossbar is horizontally positioned transverse to the path of travel of the container blank.

18. Apparatus as defined in claim 17 wherein said crossbar moves substantially vertically between an upper and lower position.

19. Apparatus for processing a series of sequentially arranged container blanks each having a plurality of sequentially arranged spaced mats, said blanks having gaps therebetween and being connected by a plurality of binding wires, said blanks having first and second sides and such edges facing each other at said gaps, said wires being located along said first side of the blanks, said apparatus comprising a frame defining a path of travel therethrough for the container blanks, means for driving said container blanks along the path of travel to a wire manipulating position, and for stopping movement of the blanks with a gap therebetween at said wire manipulating position; means for cutting the binding wires at said gap in the wire manipulating position to form cut wire sections, means for bending the cut wire sections through 90° perpendicular to the first side of the blanks and over said facing edged thereof, means for wiping the thus cut and bent wire sections through another 90° bend against the second side of their associated mats, and means for clinching the thus bent and cut wire sections into the second sides of their associated adjacent mat.

20. Apparatus as defined in claim 19 wherein said clinching means and said wiping means are combined in the same mechanism to operate in sequence.

21. Apparatus as defined in claim 19 which further comprises means for moving said cutter bend, wiper and clincher means in timed sequence between a first position and a second position to perform their respective operations.

22. Apparatus as defined in claim 19 which further comprises a means for securely holding said container blank in the wire manipulating position.

23. Apparatus as defined in claim 22 wherein said holding means comprises a stock presser mounted in said frame along the path of travel of said container blank for applying vertical pressure on the container blank and a set of stock guides mounted parallel to the path of travel to prevent lateral motion for the blank as it passes through the machine.

24. Apparatus as defined in claim 23 wherein at least one of the stock guides is adjustable to accommodate blanks of varying width.

25. Apparatus for securing girth binding wires to the sides of a container wherein wire manipulations are performed on a wire section secured to a first side of a series of container blanks, said wire manipulations being performed at gaps between successive blanks to bend the binding wire ends first through 90° over the edge of the first sides of adjacent blanks at the gap then through an additional 90° under said edges of the first sides of the adjacent blanks to be generally parallel to a second side of the blanks below said first sides and then to clinch them into the container second sides of the blanks, said apparatus comprising a frame defining a path of travel therethrough for the container blanks, means for driving the container blanks along the path of travel to a wire manipulating position, first and second crossbars vertically reciprocally mounted in said frame transversely positioned respectively above and below the path of travel of said container of blanks for movement between upper and lower positions, means for vertically reciprocating said crossbars in accordance with a predetermined sequence, a first wire manipulating means mounted on said first crossbar above the path of travel of said container blanks including means for cutting said wire section and bending it downward over the edges of the first side of a container blank as said first crossbar is driven to its lower position and a second wire manipulating means mounted on said second crossbar below the path of travel of said container blanks including means for wiping the thus cut and bent wire section through another 90° beneath the container blank and against the second side of the container blank and clinching it to said second side as side second crossbar is driven to its upper position.

26. Apparatus as defined in claim 25 wherein said means for driving the container blank along the path of travel is a shuttle system comprising a horizontal track running below and substantially parallel to the path of travel of the container blank, a shuttle carriage horizontally moveable along said track between a first and second position, a shuttle dog pivotally mounted on said shuttle carriage for engaging a container blank in said first position and driving it to said second position, a biasing spring positioned between said shuttle dog and said shuttle carriage for maintaining the shuttle dog in its upward position, a shuttle bar mounted to said shuttle carriage, and a means for driving said shuttle bar and said shuttle carriage reciprocally and horizontally along the track in a timed sequence between said first and second position.

27. Apparatus as defined in claim 25 wherein said first wire manipulating means is a cutter-bender assembly for cutting a girth binding wire and bending it downward as the first crossbar is driven downward, said assembly comprising a set of parallel cutter blades, a cutter body, a set of wedge-shaped cutter guide plates each having a vertical slot therein mounted on said cutter body and defining a chamber for said cutter blades parallel to said vertical slot, a cutter pivot pin connecting the cutter blades and extending through the vertical slots in the cutter guide plates such that the vertical movement of the cutter blades within the chamber is determined by the vertical movement of the cutter pivot pin in the slots in the cutter guide plate, a set of cam rollers rotatably fixed at the mouth of the chamber such that as the cutter blades retract into the chamber the cam rollers force the cutter blades to close and cut the binding wire, a set of cutter stop blocks attached to the ends of the cutter pivot pin, a set of cutter guide rods attached to the top of the cutter stop blocks and extending vertically perpendicular to said cutter pivot pin, a cutter assembly mounting plate adapted to secure the cutter assembly to the upper vertical crossbar and having two guide holes through which the cutter guide rods extend, a set of cutter biasing springs through which the cutter guide rods pass, said springs being compressed between the cutter assembly mounting plate and the cutter stop blocks to maintain the cutter blades extended and apart, and a set of cutter stop bolts mounted to the frame in alignment with the cutter stop blocks such that, as the first crossbar is lowered, said cutter stop blocks contact the cutter stop bolts at a predetermined position causing the cutter blades, attached to the cutter stop blocks through the cutter pivot pin, to straddle the binding wire and as the first crossbar continues the downward cycle the cam rollers at the mouth of the chamber force the cutter blades to close cutting the binding wire and allowing the cutter guide plates to continue down to bend the cut wire downward before the first crossbar returns upward to its original position.

28. Apparatus as defined in claim 27 wherein said second wire manipulating means is a bender-clincher assembly adapted for bending and clinching a cut girth binding wire as the crossbar is driven upward, said assembly comprising a set of clincher back up plates fixed to said frame above the path of travel of the container blank, a set of wire bender arms with a vertical V-shaped channel therein to engage the cut girth binding wires, a set of rollers, a set of roller arms connecting said rollers to said wire bender arms such that said rollers extend out from the V-shaped channel and above the top edge of the wire bender arms to engage the bottom of the container blank and hold it securely against said clincher back up plates, a set of vertical clincher arms, a set of bender guide plates having symmetrical vertical arch-shaped slots therein, said plates being attached to said vertical clincher arms to define a passage for the wire bender arms, pivot pins moveably maintaining said wire bender arms within said symmetrical vertical arch-shaped slots in the bender guide plate and allowing said bender arms to move between a fully extended triangular position and a fully retracted parallel position, a set of clinch anvils mounted on the vertical clincher arms such that when the binder arms are fully retracted and parallel the clincher anvil meshes with the vertical V-shaped channel in said bender arms and the top of the clincher anvil extends above the top edge of the bender arms to clinch the binding wire into the container blank and biasing springs connecting the wire bender arms and the binder guide plates for normally maintaining the wire bender arms in their fully extended position.

29. Apparatus for securing girth binding wires to the sides of a container wherein wire manipulations are performed on a wire section secured to container blanks to bend the binding wire ends over the top edge of the sides and clinch them into the container blank, said apparatus comprising a frame defining a path of travel therethrough for the container blank, means for driving the container blank along the path of travel to a wire manipulating position, first and second crossbars vertically reciprocally mounted in said frame transversely positioned respectively above and below the path of travel of said container blank for movement between upper and lower positions, means for vertically reciprocating said crossbars in accordance with a predetermined sequence, a first wire manipulating means mounted on said first crossbar above the path of travel of said container blank including means for cutting said wire section and bending it downward as said first crossbar is driven to its lower position and a second wire manipulating means mounted on said second crossbar below the path of travel of said container blank including means for wiping said cut and bent wire section against the container blank and clinching it thereto as said second crossbar is driven to its upper position; wherein said means for driving the container blank along the path of travel is a shuttle system comprising a horizontal track running below and substantially parallel to the path of travel of the container blank, a shuttle carriage horizontally movable along said track between a first and second position, a shuttle dog pivotally mounted on said shuttle carriage for engaging a container blank in said first position and driving it to said second position, a biasing spring positioned between said shuttle dog and said shuttle carriage for maintaining the shuttle dog in its upward position, a shuttle bar mounted to said shuttle carriage, and a means for driving said shuttle bar and said shuttle carriage reciprocally and horizontally along the track in a timed sequence between said first and second position; and wherein said first wire manipulating means is a cutter-bender assembly for cutting a girth binding wire and bending it downward as the first crossbar is driven downward, said assembly comprising a set of parallel cutter blades, a cutter body, a set of wedge-shaped cutter guide plates each having a vertical slot therein mounted on said cutter body and defining a chamber for said cutter blades parallel to said vertical slot, a cutter pivot pin connecting the cutter blades and extending through the vertical slots in the cutter guide plates such that the vertical movement of the cutter blades within the chamber is determined by the vertical movement of the cutter pivot pin in the slots in the cutter guide plate, a set of cam rollers rotatably fixed at the mouth of the chamber such that as the cutter blades retract into the chamber the cam rollers force the cutter blades to close and cut the binding wire, a set of cutter stop blocks attached to the ends of the cutter pivot pin, a set of cutter guide rods attached to the top of the cutter stop blocks and extending vertically perpendicular to said cutter pivot pin, a cutter assembly mounting plate adapted to secure the cutter assembly to the upper vertical crossbar and having two guide holes through which the cutter guide rods extend, a set of cutter biasing springs through which the cutter guide rods pass, said springs being compressed between the cutter assembly mounting plate and the cutter stop blocks to maintain the cutter blades extended and apart, and a set of cutter stop bolts mounted to the frame in alignment with the cutter stop blocks such that, as the first crossbar is lowered, said cutter stop blocks contact the cutter stop bolts at a predetermined position causing the cutter blades, attached to the cutter stop blocks through the cutter pivot pin, to straddle the binding wire and as the first crossbar continues the downward cycle the cam rollers at the mouth of the chamber force the cutter blades to close cutting the binding wire and allowing the cutter guide plates to continue down to bend the cut wire downward before the first crossbar returns upward to its original position.

30. Apparatus as defined in claim 29 wherein said second wire manipulating means is a bender-clincher assembly adapted for bending and clinching a cut girth binding wire as the crossbar is driven upward, said assembly comprising a set of clincher back up plates fixed to said frame above the path of travel of the container blank, a set of wire bender arms with a vertical V-shaped channel therein to engage the cut girth binding wires, a set of rollers, a set of roller arms connecting said rollers to said wire bender arms such that said rollers extend out from the V-shaped channel and above the tope edge of the wire bender arms to engage the bottom of the container blank and hold it securely against said clincher back up plates, a set of vertical clincher arms, a set of bender guide plates having symmetricial vertical arch-shaped slot therein, said plates being attached to said vertical clincher arms to define a passage for the wire bender arms, pivot pins movably maintaining said wire bender arms within said symmetrical vertical arch-shaped slots in the bender guide plate and allowing said bender arms to move between a fully extended triangular position and a fully retracted parallel position, a set of clinch anvils mounted on the vertical clincher arms such that when the binder arms are fully retracted and parallel the clincher anvil meshes with the vertical V-shaped channel in said bender arms and the top of the clincher anvil extends above the top edge of the bender arms to clinch the binding wire into the container blank and biasing springs connecting the wire bender arms and the binder guide plates for normally maintaining the wire bender arms in their fully extended position.

* * * * *